US006968952B2

(12) United States Patent
Crevier et al.

(10) Patent No.: US 6,968,952 B2
(45) Date of Patent: Nov. 29, 2005

(54) PACKAGE WITH PEEL SEAL TAPE BETWEEN COMPARTMENTS AND METHOD OF MANUFACTURE

(75) Inventors: Donald L. Crevier, Essex, IL (US); James H. Pool, Lake Forest, CA (US)

(73) Assignee: Illinois Tool Works Inc., Glenview, IL (US)

( * ) Notice: Subject to any disclaimer, the term of this patent is extended or adjusted under 35 U.S.C. 154(b) by 194 days.

(21) Appl. No.: 10/150,433

(22) Filed: May 17, 2002

(65) Prior Publication Data

US 2003/0213708 A1 Nov. 20, 2003

(51) Int. Cl.[7] ..... B65D 73/00

(52) U.S. Cl. ..... 206/484; 206/813; 206/819; 206/219; 428/35.7; 428/99; 428/516; 428/355; 428/317.7; 428/413; 220/359.1; 383/61.2; 383/210

(58) Field of Search ..... 206/219, 220, 206/221, 222, 447, 484, 524.2, 524.3, 813, 206/568; 383/38; 428/355, 317.7, 413

(56) References Cited

U.S. PATENT DOCUMENTS

| | | | | |
|---|---|---|---|---|
| 3,608,709 A | * | 9/1971 | Pike | 206/219 |
| 3,879,492 A | | 4/1975 | Bontinick | |
| 4,145,449 A | * | 3/1979 | Nelham | 426/120 |
| 4,181,711 A | * | 1/1980 | Ohashi et al. | 428/40.6 |
| 4,201,031 A | | 5/1980 | Wiles | |
| 4,402,402 A | * | 9/1983 | Pike | 206/219 |
| 4,771,935 A | | 9/1988 | Hekal | |
| 4,812,192 A | | 3/1989 | Woods et al. | |
| 5,019,027 A | | 5/1991 | Boeckmann et al. | |
| 5,273,511 A | | 12/1993 | Boeckman | |
| 5,287,961 A | | 2/1994 | Herran | 206/219 |
| 5,604,000 A | | 2/1997 | May | |
| 5,699,653 A | | 12/1997 | Hartman et al. | |
| 5,832,570 A | * | 11/1998 | Thorpe et al. | 24/585.12 |
| 5,836,445 A | | 11/1998 | Provonchee | |
| 5,904,425 A | | 5/1999 | May | |
| 5,907,908 A | | 6/1999 | Cunanan et al. | |
| 5,930,877 A | | 8/1999 | Thorpe et al. | |
| 5,944,709 A | | 8/1999 | Barney et al. | |
| 6,036,004 A | | 3/2000 | Bowen | |
| 6,080,252 A | | 6/2000 | Plourde | |
| 6,138,439 A | | 10/2000 | McMahon et al. | |
| 6,183,134 B1 | | 2/2001 | Malin | |
| 6,245,176 B1 | | 6/2001 | Greenland | |
| 6,284,360 B1 | * | 9/2001 | Johnson et al. | 428/317.7 |
| 6,317,939 B1 | | 11/2001 | Malin | |
| 6,319,243 B1 | | 11/2001 | Becker et al. | |
| 6,406,782 B2 | * | 6/2002 | Johnson et al. | 428/317.7 |

FOREIGN PATENT DOCUMENTS

EP 0122721 B1 7/1988

* cited by examiner

*Primary Examiner*—Jila M. Mohandesi
(74) *Attorney, Agent, or Firm*—Ostrager Chong Flaherty & Broitman P.C.

(57) ABSTRACT

A package having two or more compartments, adjacent compartments being seperated by a peel seal tape. A peel seal is formed by joining peel seal material coated on one surface of a substrate to one package wall, the other surface being coated with sealant material for hard sealing the substrate to the package wall. The substrate and coatings are formed by extrusion. The adjacent compartments of the package are filled with different materials. When one compartment is squeezed with sufficient pressure, that pressure breaks open the peel seal, allowing the respective contents of the two compartments to be mixed without removing the contents from the still externally sealed package.

16 Claims, 5 Drawing Sheets

PACKAGE WITH PEEL SEAL TAPE BETWEEN COMPARTMENTS AND METHOD OF MANUFACTURE

BACKGROUND OF THE INVENTION

The present invention relates to packages for storing components of an admixture in separate compartments and then admixing those stored components inside the package when the admixture is to be used. More specifically, the invention relates to packages of the foregoing type for use in mixing medical solutions, food ingredients, and so forth.

A variety of medical solutions are stored in flexible plastic packages. Such medical solutions can include, for example, parenteral, enteral, dialysis solutions, nutrients and pharmacologic agents, including gene therapy and chemotherapy agents. However, a number of issues can limit the ability to store at least certain medical solutions. For example, due to stability, compatibility or other concerns, a number of medical solutions cannot be premixed. Rather, the individual components must be stored separately. Typically these components are either stored in separate packages and admixed before use, or are stored in separate compartments of a flexible package and then mixed prior to use. For example, amino acids and dextrose solutions require stored in separate packages or compartments.

One of the disadvantages of storing components in separate packages or containers and then mixing them together is that the mixing process can compromise sterility of the system and/or process. Additionally, such a mixing process creates a labor-intensive process. Still further, it is possible for mistakes to occur during the admixing process due to the amount of solution to be added from the separate packages into the final container for the patient.

To deal with the disadvantages of separate packages, it is known to provide flexible packages that include multiple chambers. To this end, such packages have an interior that defines two or more chambers. One way to create such packages is with a heat seal that divides the interior into two chambers. The seal between any two compartments must be able to withstand external stresses. Such stresses can include pressure that may be applied to one or more of the chambers from, for example, squeezing thereof or accidentally dropping the bag. Therefore the seal must be sufficiently strong, yet not so strong that it is not possible to mix the solutions contained therein.

U.S. Pat. No. 6,319,243 discloses a multi-chamber package that can be used to house multiple liquid components that are to be stored separately prior to use. Peelable seals are provided between adjacent chambers. The peelable seals allow for the selected opening of the chambers to allow for the selective mixing of the liquids contained therein. The walls of the package are made of a film laminated having four layers. The innermost layer is a sealant layer constructed of: (1) a bulk polyolefin (preferably, a polypropylene-ethylene copolymer) that melts at a temperature below the melting temperature of the outermost layer (made, e.g., of polyester material); and (2) a thermoplastic elastomer. For example, the sealand layer may include SEBS and ethylene polypropylene. The next innermost layer made of a RF-responsive polymer, such as EVA copolumer. The sealant layer is adjacent the solution side of the package. When the opposing sealant layers are bonded, a peel seal is formed between adjacent compartments. When that peel seal is ruptured, communication is provided between chambers. As constructed the four-layer film has at least one RF-responsive layer and one non-RF-responsive layer, to wit, the sealant layer. To create the seals, a RF field heats a seal bar, which heats the RF-responsive layer, which in turn heats the non-RF responsive sealant layer to soften, but not liquefy, the latter. A resulting cohesive bond develops from contact between the sealant layers of the opposing walls of the package, but fusion between the layers, which can cause permanent bonding, does not occur. To form the peelable seal using radio frequency welding or other forms of heating sealing technology, a seal bar is used.

As flexible barrier packages for consumer goods have continued to evolve and gain consumer acceptance in the world market, manufacturers of heat sealable packaging films have developed many specialty products with consumer convenience and practicality in mind. The easy open package is one such innovation. These types of film products are designed to provide hermetic heat seals with a calculated strength.

Existing methods of producing easy-open flexible packages include sealing together two different types of films under carefully controlled conditions. The resulting heat seal is a thermoplastic adhesive bond that can be pulled apart. Such an easy open seal may be described as an "adhesive rupture" mechanism. An example of such a seal is the bond that may be formed between a low-density polyethylene film sealed to a rubber-modified high-density polyethylene film. Peelable heat seals of this type require the use of two distinct materials.

Another method of producing peelable heat seals involves the use of "cohesive rupture" films. These films form peelable seals when sealed to themselves or to a standard packaging film made from a compatible polymer. The peel mechanism is created at the time of extrusion. The film sealant layer is comprised of a homogenized blend of various heat-sealable, non-heat-sealable, and compatible polymers that will not form a solution. The polymer matrix adjacent the heat area has a calculated cohesive strength. As the heat seals are pulled apart, the polymer matrix splits. The strength of the obtained heat seal may be altered by the exact formula percentages utilized in the homogenized blend. A further benefit of such a system is the visible evidence that a hermetic seal has been produced as witnessed by the transfer of material upon opening.

For example, U.S. Pat. No. 6,245,176 discloses a flexible package having compartments seperated by a "cohesive rupture" peel seal. A layer of peel seal material is applied as a coating along a zone on an inner layer of a plastic laminate, the inner layer comprising polyethylene and the substrate comprising polyester. The peel seal material contains 5 to 20 percent polybutylene by weight. The peel seal material is applied by heat sealing using a sealing bar. This substrate, zone-coated with peel seal material, is then used to produce a two-compartment mixing package. The zone-coated film is overlaid with a second layer of polyethylene film supported by a polyester substrate. The polyethylene sealant layers are confronting. Side heat seals and a center peel seal are formed. Two distinct compartments are defined by the upper and lower film walls and the side seals, and separated by the peel seal.

There is a need for a package that has an interior peel seal separating adjacent compartments and that can be manufactured inexpensively.

BRIEF DESCRIPTION OF THE INVENTION

The invention is directed to a peel seal tape and to a package having two or more compatments, adjacent compartments being separated by a peel seal tape. A peel seal is formed by joining peel material coated on one surface of a substrate to one package wall, the other surface of the substrate being coated with sealant material for hard sealing the substrate to the other package wall. The substrate is formed by extrusion. The coating are also applied by extrusion. The adjacent compartments of the package are filled with different materials. As used herein, the term "material" includes liquids, solutions, colloids, powders, blends, particulate matter, and any other matter that can be admixed. When one compartment is squeezed with sufficient pressure, that pressure breaks open the peel seal, allowing the respective contents of the two compartments to be mixed without removing the contents from the still externally sealed package.

One aspect of the invention is a peel seal tape comprising: a substrate; a coating of peel seal material applied on at least a zone of one surface of the substrate; and a coating of sealant material applied on at least a zone of another surface of the substrate. The sealant material and peel material melt at temperatures lower than a melting temperature of the substrate.

Another aspect of the invention is a multi-compartment package comprising: first and second external walls joined to each other along at least part of a periphery to form a receptacle having an interior volume; and peel seal tape disposed between and joined to the first and second external walls in a zone that divides the interior volume into first and second compartments. The first compartment contains first material and the second compartment contains second material different than the first material. The peel seal tape comprises a substrate; a coating of peel seal material applied on one substrate surface and joined to the first external wall; and a coating of sealant material applied on another substrate surface and joined to the second external wall.

A further aspect of the invention is a peel seal tape comprising: a substrate; a coating of peel seal material applied on first and second mutually parallel zones of one surface of the substrate; and a coating of sealant material applied on at least a zone of the other surface of the substrate. The sealant material and peel material melt at temperatures lower than a melting temperature of the substrate.

Yet another aspect of the invention is a package comprising: first and second external walls joined or connected along portions of a periphery to form a receptacle having first and second sides and a bottom, the receptacle having a mouth along a remainder of the periphery; and peel seal tape joined to an interior surface of the first external wall. The peel seal tape extends from the first side to the second side of the receptacle, but does not form a peel seal. The peel seal tape comprises: a substrate; a coating of peel seal material applied on one substrate surface; and a coating of sealant material applied on another substrate surface and joined to the first external wall.

A further aspect of the invention is a method of manufacturing a package, comprising the following steps: feeding a web of film material and a peel seal tape to a peel seal tape application station. The peel seal tape comprises a substrate, a coating of peel seal material on one side of the substrate, and a coating of sealant material on the other side of the substrate. The method further comprises the step of joining the sealant material of the peel seal tape to the web of film material at the peel seal tape application station. The joining step is performed without activating the peel seal. The method further comprises the step of forming a receptacle comprising first and second walls joined along a periphery except along a peripheral portion defining a mouth. In one embodiment, the receptacle is formed by folding and heat sealing. In another embodiment, the receptacle is formed by heat sealing overlapping webs.

Other aspects of the invention are disclosed and claimed below.

DETAILED DESCRIPTION OF THE INVENTION

Figure 1:
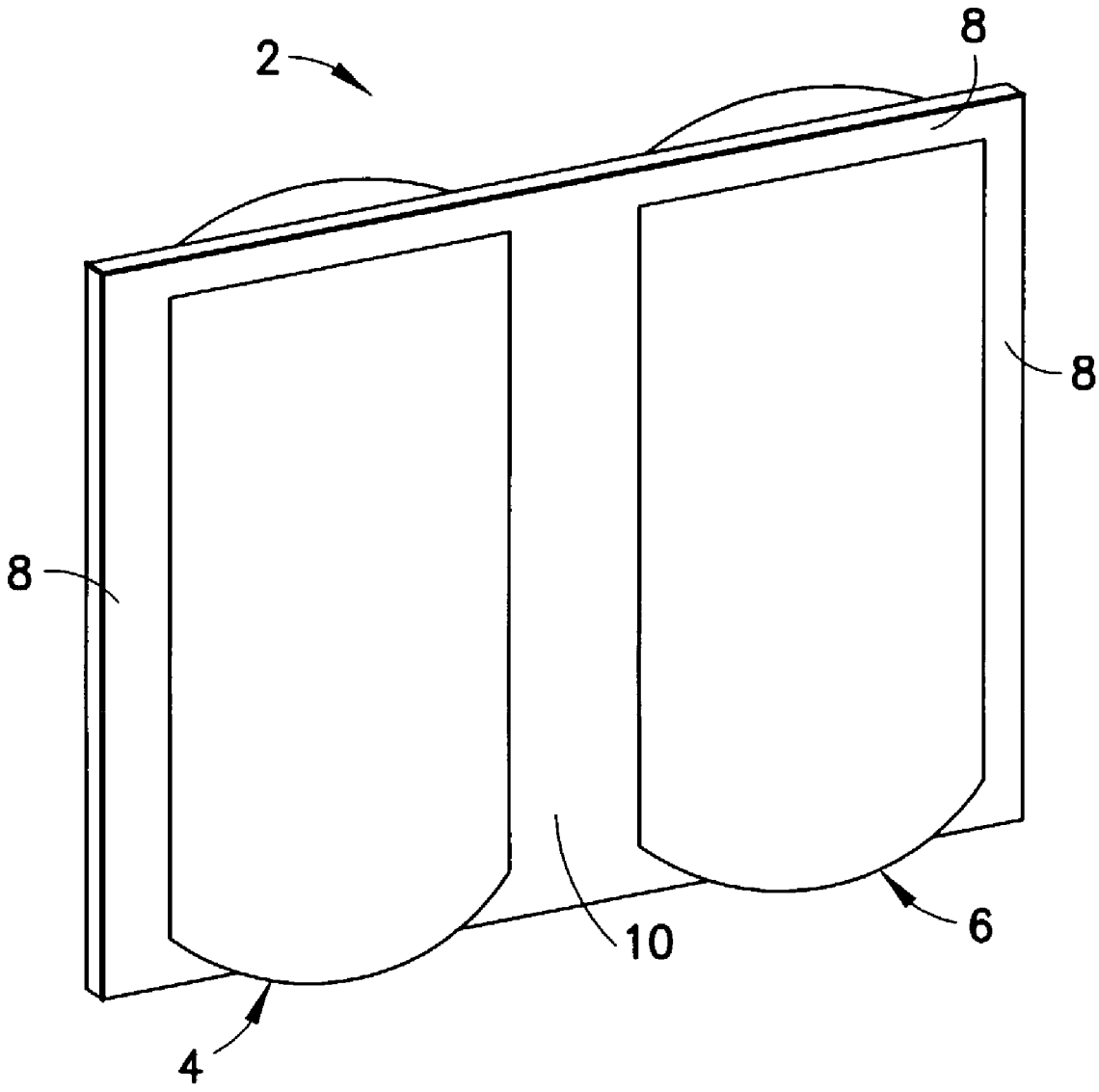
FIG. 1 is a schematic showing an isometric view of a flexible package having two compartments.

FIG. 1 shows one embodiment of a multi-compartment package 2 that has two compartments 4 and 6 filled with different materials. The filled package is hard sealed along its entire periphery 8, which in the embodiment depicted in FIG. 1 is generally rectangular. The filled compartments are separated by an intermediate peel-sealed region 10. In region 10 the front and rear walls of the package 2 are joined together by an internal peel seal.

Although not shown in FIG. 1, the peel-sealed region 10 is a laminated structure with a substrate in the form of an extruded, relatively stiff thermoplastic strip at the center. The substrate may comprise one layer or a plurality of co-extruded layers. One side of the substrate is coated with an extruded layer of thermoplastic peel seal material; the other side of the substrate is coated with an extruded layer of low-melting-point thermoplastic sealant material. The substrate coated on both sides in the foregoing manner will be referred to herein as "peel seal tape".

In the final filled package, the peel seal material is joined to one wall of the package, while the sealant material is joined to the other wall. Thus the peel seal tape is joined to both walls of the package. As explained below, these joining steps are performed in seperate operations at different times, the sealant material being joined to a package wall before the first compartment is filled with product, and the peel seal material being joined to the other package wall after the first compartment has been filled.

The walls of the package may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. Furthermore, the package walls may have a laminated structure, with one of the surface layers being a layer of low-melting-point sealant material, to facilitate sealing of the package. The sealant layer of such bag material may be made of the same material as the substrate sealant layer, or the low-melting sealant materials of the package wall and of the substrate may comprise different compatible materials.

The low-melting-point sealant material applied on one side of the substrate has a melting temperature that is lower than the melting temperature of the substrate. The peel seal material applied on the other side of the substrate has a pressure and temperature sealing window for being peelable. More specifically, the peel seal material forms a hard seal at the temperature and pressure at which the low-melting sealant material is activated, and forms a peelable seal when a temperature and a pressure within the aforementioned peel sealing window are applied, the peel sealing window temperature range being lower than the temperature at which the low-melting sealant material is activated. The periphery 8 of the package 2 (see FIG. 1) is hare sealed at the latter temperature, while the internal peel seal in region 10 is activated at a lower temperature within the peel sealing window.

Figure 2:
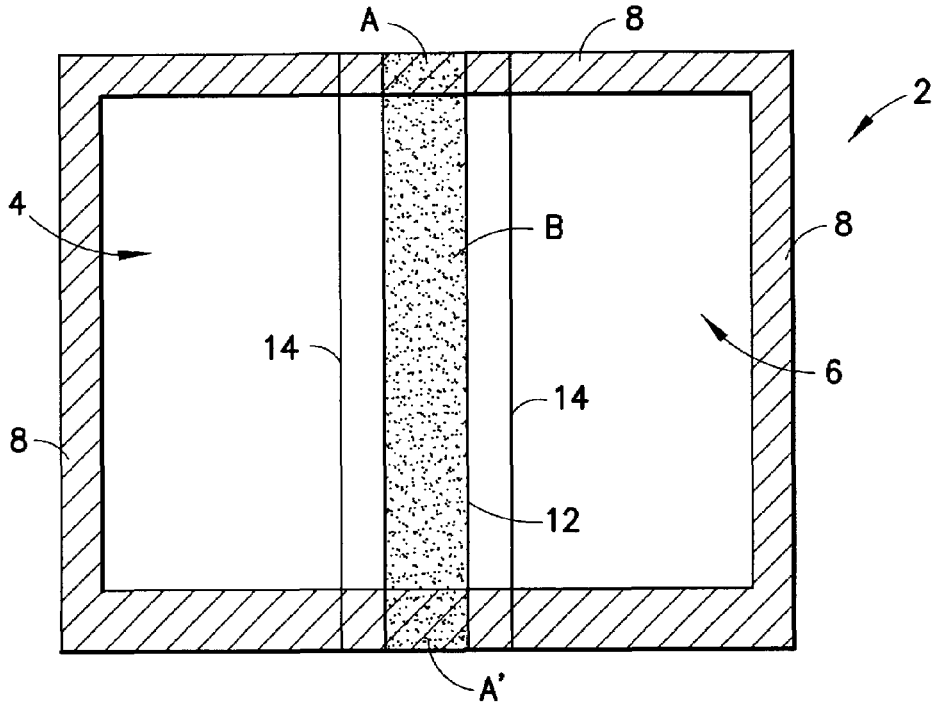
FIG. 2 is a schematic showing a top plan view of a two-compartment package in accordance with one embodiment of the invention.

The geometric relationship of the periphery 8 and the peel seal in the embodiment of FIG. 1 is depicted in FIG. 2. The speckled strip labeled 12 represents the strip-shaped zone of peel seal material coated on one side of the substrate 14. The coating of sealant material on the other side of the substrate 14 is not shown, but preferably covers the entire surface on that side of the substrate. The substrate 14 and the peel seal and sealant coatings on opposing sides of the substrate are referred to herein as a "peel seal tape". The peel seal tape runs the full height of the package. Thus the end sections of the peel seal tape are overlapped by the hard-sealed periphery 8, which is indicated by hatching in FIG. 2.

Preferably the front and rear walls of the package comprise laminated film material having a layer of low-melting-point sealant material, the film material of the opposing walls being disposed with the respective layers of sealant material confronting each other. The peripheral hard seal 8 is formed by heat sealing the opposing walls along their peripheries at temperatures that cause the sealant layers to activate. Heat sealing of different portions of the periphery 8 is performed at different times in seperate steps, with the final heat sealing step being performed only after the last compartment of the package has been filled. When the peripheral edges that run transverse to the peel seal tape are heat sealed, the sealing temperature is sufficiently high that the peel seal material in zones A and A' (indicated by the small rectangular areas in FIG. 2 that are both speckled and hatched) is activated to form a hard seal. In a separate operation performed before the first compartment is filled, the sealant layer of the peel seal tape is joined to the sealant layer of one package wall, again forming a hard seal. This heat sealing step is performed under conditions such that the peel seal material on the other side of the peel seal tape is not activated, forming neither a peelable seal nor a hard seal. Only later (after the first compartment is filled) will the zone B of peel seal material (indicated by the rectangular area in FIG. 2 that is speckled and not hatched) be activated to form a peelable seal between the substrate of the peel seal tape and the adjoining wall of the package. Thus, in the regions (zones A and A') of overlap with periphery, the peel seal material is joined to the package film material to form a hard seal, while the strip (zone B) of peel seal material extending between the regions of overlap is joined to the package film material to form the peel seal.

In one method of manufacturing the package depicted in FIG. 2, the peel seal tape is hear sealed to a first continuous web of film material; a second continuous web of film material is laid over the first web with the tape therebetween; the first and second webs are heat sealed together along three lines of joinder, one parallel to the peel seal tape and two transverse to the peel seal tape; and the joined webs of film material are cut along the transverse heat seals. The fourth side of the package is open. Later, the interior volume of the package will be filled with a first product to a level below the peel seal tape; then the peel seal will be activated by application of heat and pressure; then the interior volume of the package above the peel seal will be filled with a second product different than the first product; and finally, the mouth of the package will be heat sealed closed.

The peel seal tape is preferably manufactured by extrusion. For the embodiments discloased herein, the substrate of the peel seal tape is made of a blend of low-density and high-density resins (e.g., HDPE and LDPE in a ratio of 60/40); the sealant material is EVA or metallocene-catalyzed LDPE; and the peel seal material is a blend of polybutylene and LDPE, the amount of polybutylene being in the range of 20 to 40 wt.%. However, the substrate may comprise multiple layers of extrudate consisting of different polymers or different blends of polymers. All of these materials are thremoplastic and extrudable, allowing the peel seal to be manufactured continuously and economically.

To manufacture the peel seal tape, conventional extrusion techniques can be employed. The substrate and coatings making up the peal seal tape can be co-extruded through multiple openings in a die plate fed by respective extruders, one containing molten sealant material, and a third containing molten peel seal material. Alternatively, the substrate could consist of multiple extruded layers. As is well known in the art, the die plate includes input ports, output ports, and channels connecting the input ports to the output ports. The extruders feed the different molten materials to different input ports, and the channels are designed to configure the molten materials into the shapes of the respective components. In the alternative, each component (i.e., substrate and coating on opposite sides thereof) may be formed in separate extrusions using different die plates. In the embodiment disclosed hereinafter, the substrate with sealant layer is co-extruded from one die and the layer of peel seal material is extruded onto the substrate from a separate die located downstream of the first die.

Figure 3:
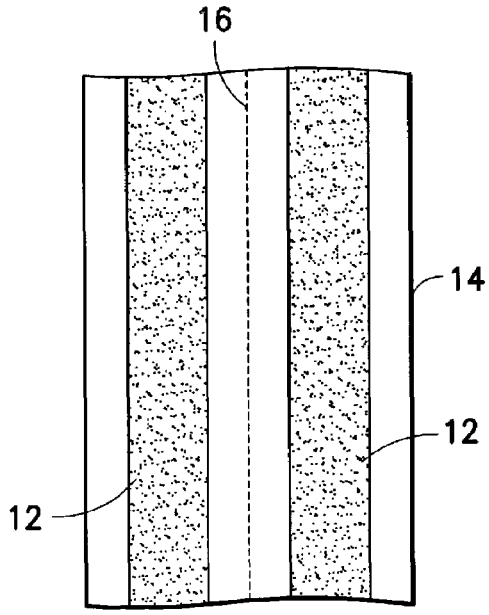
FIG. 3 is a schematic showing a top view of a peel seal tape made by extrusion and perforation in accordance with another embodiment of the invention.

Optionally, more than one peel seal tape can be manufactured concurrently. For example, referring to FIG. 3, the sealant layer and the substrate material can be extruded at a width that is twice the width of the desired peel seal tape. Then two mutually parallel zones 12 of peel seal material are extruded onto the substrate 14 on the side opposite the sealant layer. After the extruded material has been cooled and set, the double-width substrate is perforated along a centerline 16 that bisects the tape longitudinally. The double tape is then torn into two strips, each strip being wound onto a respective spool. Later, during manufacture of packages, the peel seal tape is unwound from the spool and fed to a peel seal tape application station for continuous application of tape to a continuous web of film material.

Figure 4:
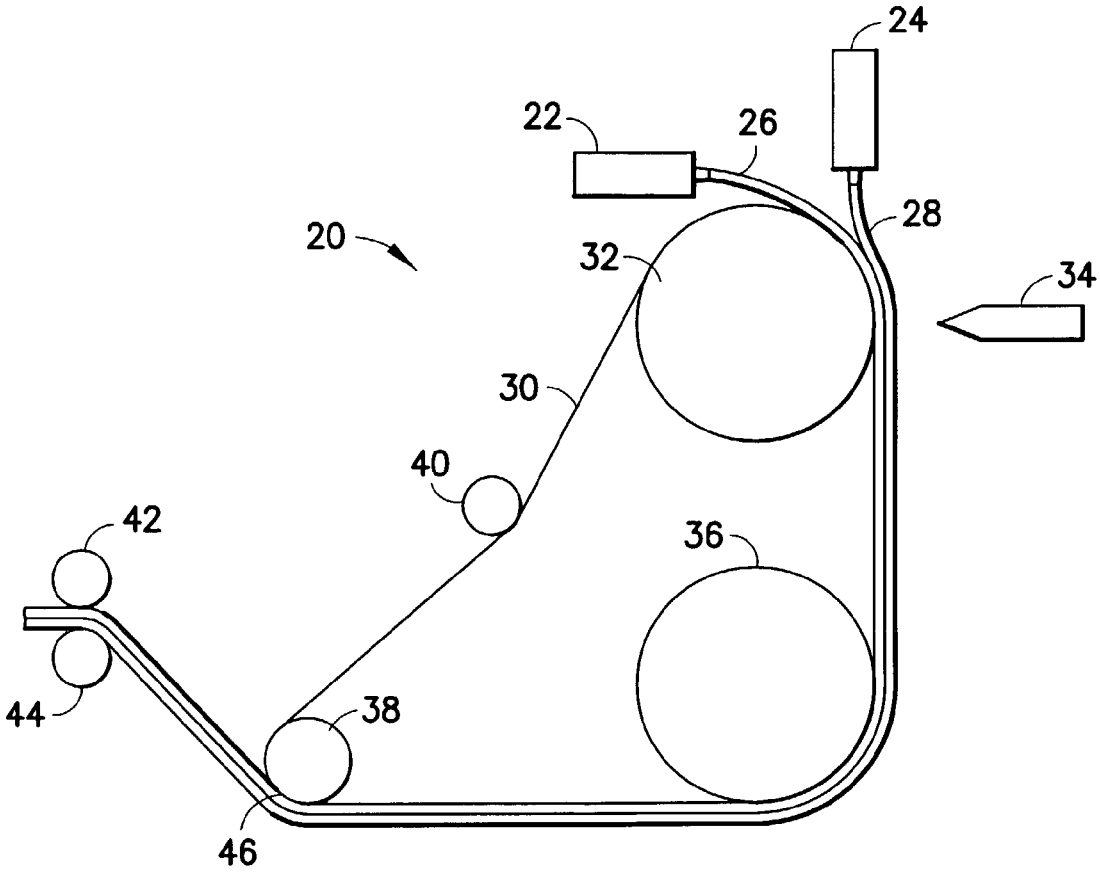
FIG. 4 is a schematic showing a side elevational view of an apparatus for manufacturing the peel seal tape depicted in FIG. 3.

FIG. 4 illustrates one type of apparatus 20 that can be used to manufacture the peel seal tape previously described. First, base extrudate 26 is co-extruded by a first die, 22, this base extrudate consisting of a layer of low-melting-point sealant material and a substrate (consisting of one or more layers), as previously described. Next, a coating 28 of peel seal material is extruded onto the base extrudate 26 by a second die 24 located downstream of the first die 22. The base extrudate 26 is deposited onto the top surface of a continuous carrier belt 30 in the area of carrier belt 30 generally supported by a cast roller 32. The peel seal material 28 is extruded onto the upper surface of a continuous carrier belt 30 in the area of carrier belt 30 generally supported by a cast roller 32. The peel seal material 28 is extruded onto the upper surface of base extrudate 26 after depositing the latter onto the carrier belt 30. Carrier belt 30 forms an endless loop around cast roller 32, a driving roller 36 and a stripping roller 38 and is driven by driving roller 36. During roller 36 is driven by an electric motor or other driving means, not shown. An adjusting/steering roller 40 is provided between stripping roller 38 and cast roller 32 to adjust and maintain the tension of the carrier belt 30. Carrier belt 30 may be made of a suitable material, such as Teflon, to which the base extrudate will not adhere or may be conditioned to prevent adherence or slippage.

The top surface of carrier belt 30 may have a texture, such as a grid-like texture. The particular texture of the carrier belt 30 is imparted to the sealant layer to increase the capability of the peel seal tape to bond to the film material of a package. By imparting a grid-like structure to the surface of the sealant layer and boding that sealant layer to a wall of a package, fluid leaks between the bonded surface of the peel seal tape and the package wall are minimized or eliminated, requiring such fluids to follow a tortuous path. At least the top surface of carrier belt 30 may also have a treatment to provide adequate adhesion so that the peel seal tape does not intermittently slip and reattach to carrier belt 30 and to allow release of the peel seal tape at the stripping point 46, as described below. The treatment may consist of raising or lowering the temperature of carrier belt 30 at specific points to facilitate such adhesion and detachment, or the treatment may be a release agent being applied to the top surface of carrier belt 30 prior to depositing the base extrudate 26 thereon.

The extruded peel seal tape (comprising extrudates 26 and 28) is cooled by an adjusting/cooling nozzle 34, thereby stabilizing and setting the sealant layer, the substrate and the peel seal layer. Water may be ejected from adjusting/cooling nozzle 34 to cool the peel seal tape extrudates. As illustrated in FIG. 4, carrier belt 30 is disposed vertically between cast roller 32 and driving roller 36, which ensures that any water deposited on the peel seal tape during cooling will be removed. While the peel seal tape is carried by carrier belt 30, no tensile forces are imparted on the peel seal tape to guide the latter through the apparatus 20. Thus, deformation of the peel seal tape during the manufacturing process is eliminated.

Finally, the peel seal tape is stripped from carrier belt 30 at the stripping point 46. The stripping point 46 is in the general area where the path of carrier belt 30 turns about stripping roller 38. After being stripped from carrier belt 30, the peel seal tape is guided through a top take-off roller 42 and a bottom take-off roller 44 for further processing, such as slitting in the case where a double peal seal tape is manufactured. The final product can be wound on a spool and stored or transported to a pouch machine for application to film material and formation of pouch. In such a pouch machine, package film material unwound from a roll and peel seal tape unwound from a spool are fed to a tape application station. Alternatively, after slitting the tape in two, the separate tapes could be provided to separate package production lines for application to packages. The unfilled packages can be transported to a converter, to be filled with product and sealed. Alternatively, the forming and filling operations could be performed in-line with package formation.

The peel steal tape is supported by carrier belt 30 while the tape is in an unsolidified and unset state. In this state, the apparatus 20 does not impart tensile forces to deform the peel seal tape. As the carrier belt 30 provides a stable base for the peel seal tape during setting, forming a relatively thin tape is possible.

Figure 5:
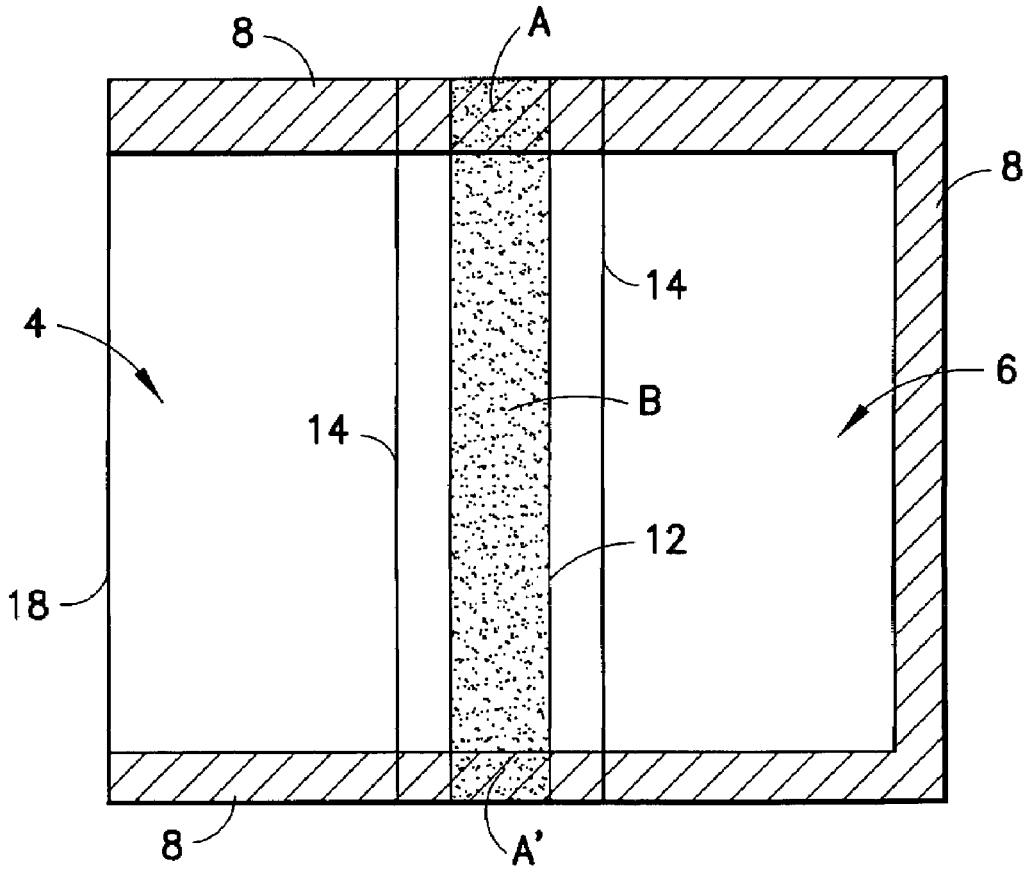
FIG. 5 is a schematic showing a top plan view of a two-compartment package in accordance with yet another embodiment of the invention.

FIG. 5 shows a package with internal peel seal in accordance with an alternative embodiment. In contrast to the embodiment shown in FIG. 2, wherein the package was heat sealed on four sides, in the embodiment shown in FIG. 5, three sides are heat sealed while the fourth side comprises a fold 18. The remainder of the package has the same structure as the package shown in FIG. 2, to wit, compartments 4 and 6 are separated by a strip of peel seal tape comprising a substrate 14 coated on one side with peel seal material 12 and on the other side with sealant material (not shown). Zones A and A' again indicate areas where the peel seal material has been heated and pressed under conditions wherein a hard seal is formed, while zone B indicates an area where the peel seal material has been heated and pressed under conditions wherein a peel seal is formed.

Figure 6:
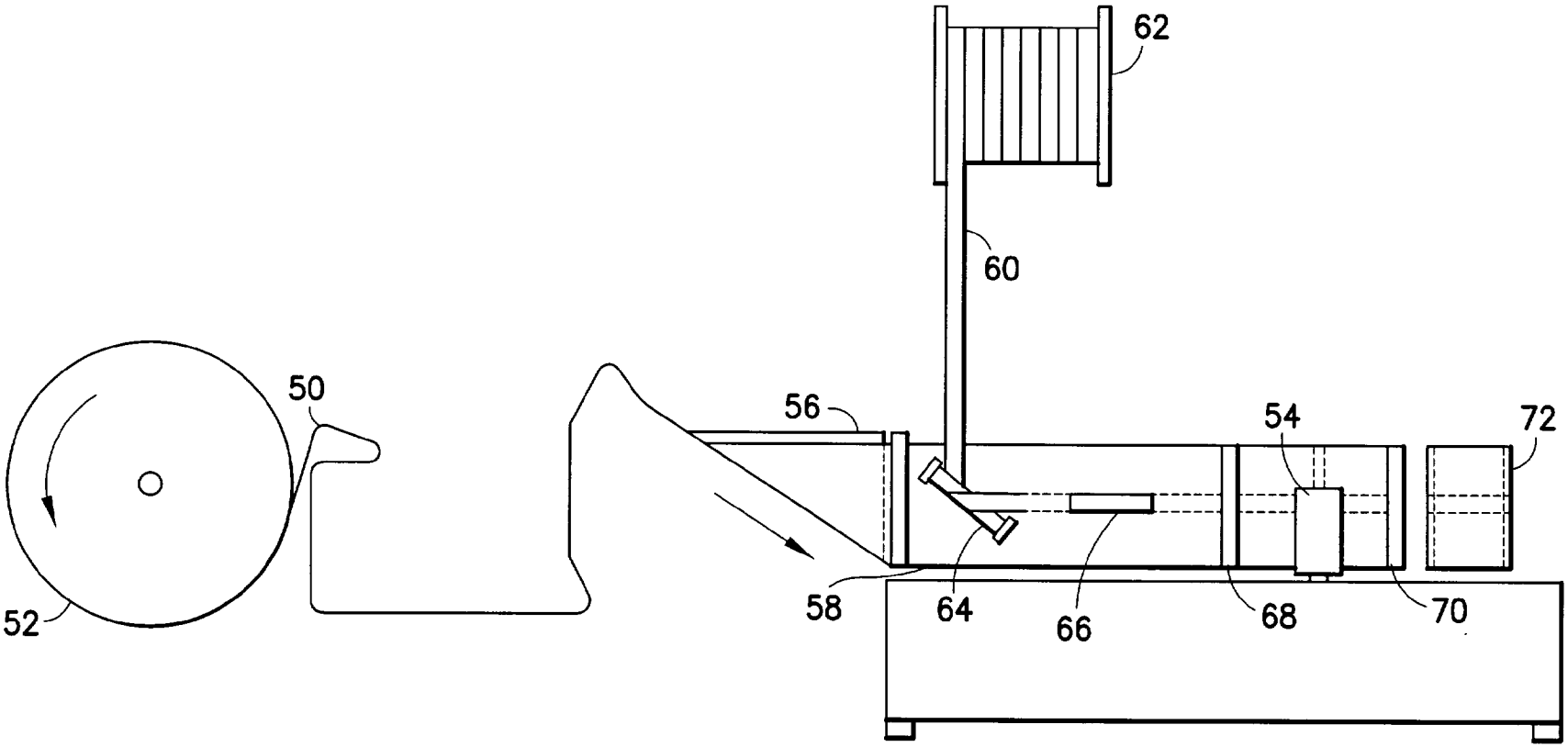
FIG. 6 is a schematic showing one method for manufacturing a package with a peel seal tape attached to one wall of the package.

FIG. 6 depicts a method of manufacturing the package depicted in FIG. 5 Package film 50 is paid off a roll 52. Downstream a pull roller 54 is provided for driving the film 50 through the machine. A folder plow 56 positioned downstream of the film roll 52 folds the package film 50 about a bottom crease 58 to form opposing package walls. Peel seal tape 60 is paid off a spool 62 and fed between the advancing package walls. The portion of tape 60 between the package walls is denoted by dashed lines in FIG. 6. The tape 60 is passed around a guide roller 64 and is fed in the machine direction at a predetermined height from the bottom fold 18 in the package film. At a first sealing station, the peel seal tape is sealed to one of the package walls on the side of the peel seal tape that has the coating of sealant material. This heat seal is made by a pair of horizontal sealing bars 66, only one of which is visible in FIG. 6. Although not shown in FIG. 6, to ensure that layer of peel seal material is not sealed to the opposite package wall, an insulator plate can be inserted between the peel seal material layer and the adjacent package wall. Also the horizontal sealing bar on that side is deactivated. After the first sealing operation, the packaging film is advanced one package increment. Then at a second sealing station, the folded film and peel seal tape are cross-sealed by a vertical sealing bar to form discrete packages. Then at a cutting station 70, the individual packages 72 are cut from one another. The separated packages 72 are then ready to be filled.

As previously noted, alternatively, the forming and filling operations could be performed in-line with package formation. In that event, after the cross seals are made, the bottom compartment is filled, the peel seal tape is hard sealed to the other bag wall, the top compartment is filled, the top compartment is hard sealed, and then the bag is cut off.

While the invention has been described with reference to various embodiments, it will be understood by those skilled in the art that various changes may be made and equivalents may be substituted for elements thereof without departing from the scope of the invention. For example, instead of the polybutylene/LDPE blend employed in the discolsed embodiment, any other extrudable peel seal material having suitable properties can be used. Similarly, the package film material, the sealant material and the tape substrate material may comprise suitable materials well known in the art other than those specifically mentioned herein. For example, low-melting-point materials suitable for use as sealant material include EVA, LDPE, VLDPE, LLDPE, and metallocene-catalyzed LLDPE. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

What is claimed is:

1. A multi-compartment package comprising:

first and second external walls joined to each other along at least part of a periphery to form a receptacle having an interior volume;

peel seal tape disposed between and joined to said first and second external walls in a zone that divides said interior volume into first and second compartments;

first material contained in said first compartment; and second material contained in said second compartment, said first and second materials having different compositions, wherein said peel seal tape comprises:

a substrate having first and second surfaces on opposite sides thereof;

a first coating of peel seal material applied on said first surface of said substrate and joined to said first external wall; and a second coating of sealant material applied on said second surface of said substrate and joined to said second external wall.

2. The package as recited in claim 1, wherein said substrate is a blend comprising low-density and high-density resins.

3. The package as recited in claim 1, wherein said peel seal material is a blend comprising polybutylene.

4. The package as recited in claim 3, wherein said peel seal blend further comprises low-density polyethylene.

5. The package as recited in claim 3, wherein the amount of polybutylene in said peel seal blend is in a range of 20 to 40 wt. %.

6. The package as recited in claim 3, wherein the amount of polybutylene in said peel seal blend is approximately 30 wt. %.

7. The package as recited in claim 1, wherein said sealant material comprises metallocene-catalyzed low-density polyethylene.

8. A peel seal tape comprising:

a substrate having first and second surfaces on opposite sides thereof;

a first coating of peel seal material applied on first and second zones of said first surface of said substrate, said first and second zones being mutually parallel; and a second coating of sealant material applied on at least a zone of said second surface of said substrate, wherein said sealant material and peel material each melt at temperatures lower than a melting temperature of said substrate.

9. The peel seal tape as recited in claim 8, wherein said substrate has a line of weakness that runs parallel to said first and second zones and is disposed midway therebetween.

10. The peel seal tape as recited in claim 9, wherein said line of weakness comprises perforations in said substrate.

11. A package comprising:

first and second external walls joined or connected along portions of a periphery to form a receptacle having first and second sides and a bottom, said receptacle having a mouth along a remainder of said periphery; and peel seal tape joined to an interior surface of said first external wall, said peel seal tape extending from said first side of said receptacle to said second side, but not forming a seal in said receptacle, wherein said peel seal tape comprises:

a substrate having first and second surfaces on opposite sides thereof;

a first coating of peel seal material applied on said first surface of said substrate; and a second coating of sealant material applied on said second surface of said substrate and joined to said interior surface of said first external wall.

12. The package as recited in claim 11, wherein said substrate is a blend comprising low-density and high-density resins.

13. The package as recited in claim 11, wherein said substrate has a stiffness greater than the stiffness of said first and second external walls.

14. The package as recited in claim 11, wherein said peel seal material is a blend comprising 20–40% polybutylene by weight.

15. The package as recited in claim 14, wherein said peel seal blend further comprises low-density polyethylene.

16. The package as recited in claim 11, wherein said sealant material comprises metallocene-catalyzed low-density polyethylene.

* * * * *